US005666788A

United States Patent [19]

Tolson

[11] Patent Number: 5,666,788

[45] Date of Patent: Sep. 16, 1997

[54] METHOD FOR TRANSVERSE SEALING OF FILM WRAPPED AROUND A PRODUCT

[75] Inventor: Sidney S. Tolson, Scotland Neck, N.C.

[73] Assignee: Ossid Corporation, Rocky Mount, N.C.

[21] Appl. No.: 633,175

[22] Filed: Apr. 16, 1996

[51] Int. Cl.[6] ..... B65B 9/00; B65B 53/02

[52] U.S. Cl. ..... 53/442; 53/450; 53/463; 53/479

[58] Field of Search ..... 53/442, 450, 479, 53/481, 374.6, 375.3, 371.6, 372.3, 463

[56] References Cited

U.S. PATENT DOCUMENTS

| | | | |
|---|---|---|---|
| 4,574,566 | 3/1986 | Eaves et al. | 53/450 |
| 5,058,361 | 10/1991 | Schmacher | 53/371.4 |
| 5,271,210 | 12/1993 | Tolson | 53/375.4 |

*Primary Examiner*—Linda Johnson
*Attorney, Agent, or Firm*—Olive & Olive, P.A.

[57] ABSTRACT

A method for heat sealing a film with a smooth seam which extends the transverse width of a wrapped package utilizes a mechanism having a cool clamping portion and a hot sealing portion which are sequentially actuated. The clamping portion, with segments upstream and downstream of a sealing position, is activated to firmly hold the film. The sealing portion is located between the upstream and downstream segments of the clamping portion. The heated sealing portion is brought into very brief, instantaneous contact with the film and retracted, leaving the clamping portion in contact with the film for a comparatively long time to allow longitudinal film shrinkage and prevent transverse film shrinkage of the film. Lastly, the clamping portion separates and the next package in a succession of film-enclosed packages is moved downstream of the sealing position.

7 Claims, 5 Drawing Sheets

METHOD FOR TRANSVERSE SEALING OF FILM WRAPPED AROUND A PRODUCT

BACKGROUND OF THE INVENTION

1. Field of the Invention

This invention relates to methods for sealing heat sealable film wrapped around a series of products, and more particularly to sealing bi-axially oriented film wrapped around a product.

2. Description of the Related Art

In the preparation of various products for market presentation to the consumer, many are wrapped in a clear film to protect the product from the environment and yet permit product visibility. Common among the products which are so wrapped are food items, especially poultry parts. The packaging of poultry parts for sale is frequently done with a film which can be shrunk when heated. The shrinking helps to achieve a smooth and attractive appearance of the package by pulling the film tightly around the product.

In the process of wrapping products such as those which are the subject of the invention, a sheet of heat sealable film of indefinite length is formed into an elongate tubular configuration, in some instances with the aid of a "former", as disclosed in U.S. Pat. No. 4,574,566 to Eaves et al., the teachings of which are incorporated herein by reference. In this process, for example, a series of products are wrapped into a film tube in linear alignment generally along the axis of the tube and are longitudinally (used herein to be in the direction of travel) spaced apart from one another. A longitudinal seam is formed by joining the opposed edges of the film sheet, and a transverse (used herein to be normal to the direction of travel) seam is formed between each of successive leading and trailing packages by means of heat and pressure. As each transverse seam is sealed, the heating substantially melts the film so that the leading package separates from the trailing package. The '566 patent also discloses a sealing mechanism for forming a transverse seam in the film tube between sequential products in which a pair of opposed rotary sealing heads are caused to revolve so as to match the direction and linear speed of the product and tube as portions of the sealing heads press upper and lower surfaces of the tube together and apply heat. According to the teaching of the '566 patent, several portions of the packaging machine conveyor are each driven by a different servomotor so as to be able to synchronize speeds more precisely than was considered possible by a mechanical drive system. However, no teaching or suggestion of speed variation between conveyor portions is made.

Another arrangement for the operation of sealing bars for producing transverse seams is disclosed in U.S. Pat. No. 5,271,210 to Tolson, the teachings of which are also incorporated herein by reference. In the apparatus described in the '210 patent, a pair of opposed linear sealing bars are moved vertically and are brought into contact with the upper and lower surfaces of the film tube as the sealing bars are conveyed in the direction of travel of the products and the tube. This action results in the contact time between the sealing bars and the film tube being maximized without slowing the speed of product conveyance. The sealing bars are then separated vertically and conveyed in the opposite direction back to their starting point. Depending on the package being wrapped and film being used, this equipment can be operated as fast as 70 packages per minute.

The '210 patent also discloses a pair of vertically oriented lateral control belts associated with the sealing bars and which are mounted and driven so as to be able to move linearly in a direction opposite to that in which the products are moved while the belts rotate in the direction of the product movement and move linearly in the same direction as the products move when the sealing bars are separated and are returning to their upstream position and while the next product is moved past the sealing bars. The lateral control belts move linearly in synchronization with the products without belt rotation while the sealing bars are pressed together to seal the transverse seam.

Sealing of two portions of heat sealable film involves heating one or both portions to near the melting point and pressing the two portions together. A common problem encountered due to the heat applied is that of film shrinkage in either or both the longitudinal and transverse directions of the film. This problem has been dealt with in various ways as next described.

Known apparatus for forming a transverse seam between successive packages includes clamps with circulating cooling fluid. A first known and typical sealing apparatus uses a cooled clamp in conjunction with an electrical resistance heating wire in a manner to instantaneously heat and deactivate the wire while continuing to hold the film with the cooling clamps. This generally results in a transverse seam being formed without allowing longitudinal shrinkage in the film.

A second known sealing apparatus utilizes a pair of clamping jaws flanking a heat sealing element upstream and a second such apparatus downstream of a film-parting knife. This apparatus prevents the film from shrinking in both the longitudinal and the transverse directions.

A third known heat sealing apparatus employs spring-mounted cooled clamps and a rigidly mounted sealing bar which are all mounted to a common carrier bar. This apparatus is discussed in detail below as the preferred apparatus with which to practice the method of the invention. This third type heat sealing apparatus has been used in a Model 500E packaging machine, sold by Ossid Corporation of Rocky Mount, N.C.

A particularly effective film for use in shrink-wrapping is a film which prior to being used as a wrapping film has been oriented, or work stretched, in two perpendicular directions. This type of film, known as bi-axially oriented film, when subjected to heat, shrinks bi-axially, thus removing wrinkles in both directions. Such a bi-axially oriented film is supplied by the Cryovac Division of W. R. Grace Chemical Co., Inc. as style SSD-310. The degree of shrink is proportional to the degree of orientation and of the heat applied. If a film is wrapped around a product, it is typically constrained and is not able to shrink to the extent it would if left unconstrained. Consequently, a residual component of film tension is created in the film. Subsequent movement of the product provokes film contraction in response to this film tension and during heat sealing in the manner described above may cause the formation of non-uniform and relatively weak seam.

Typically, poultry products are handled and wrapped while frozen or semi-frozen (firm) at a temperature of about −15° C. (0° C.). These same poultry products are displayed in a retail store at a temperature sufficient to maintain freshness and enhance appearance, i.e. 1° C. (34° F.). Thus, both the sealing system and the film employed must accommodate to a wide range of temperatures.

The longitudinal seam formed along the bottom of the package is considered to be generally uniform and satisfactory. However, according to all known heat sealing apparatus and methods, seal integrity of the transverse seam is marginal and fairly irregular in form.

It is therefore an object of this invention to provide an improved sealing method capable of controlling the movement of a heat shrinkable film during heat sealing to establish a uniform, strong transverse seam.

Other objects and advantages will be more fully apparent from the following disclosure and appended claims.

SUMMARY OF THE INVENTION

A sealing method is provided for transverse sealing a heat sealable film wrapped around a product. The sealing mechanism employed in the invention method comprises a first pair and an opposed second pair of spaced apart film clamps, which pairs of clamps are moved together so as to engage film disposed between respective upper and lower members of the pairs of clamps. The film clamps are cooled, and each pair includes an upstream clamp and a downstream clamp with a space therebetween. A vertically moveable first heated sealing bar resides between the respective upstream and downstream clamps of at least one pair of film clamps. A platen or a second heated sealing bar is located opposite the first heated sealing bar. According to the invention method, the pairs of clamps engage and hold opposed portions of the film, and the platen or second heated sealing bar is moved to instantaneously engage the first heated sealing bar and contact the respective upper and lower sections of film at a location between the respective clamped upstream and downstream film portions so as to weld the sections together. The first heated sealing bar and the platen or second heated sealing bar are quickly retracted as soon as the seal has been formed, whereas the cooled clamps hold the film portions together for a relatively long time. In this manner, pressure is maintained on the film and the sealed portion of film is allowed to shrink longitudinally, but not shrink transversely. Lastly, the film clamps are separated to release what is now a smooth transverse seam in preparation for forming of the next seal. A bi-axially oriented film is used as the preferred form of film.

DETAILED DESCRIPTION OF THE INVENTION

Figure 5:
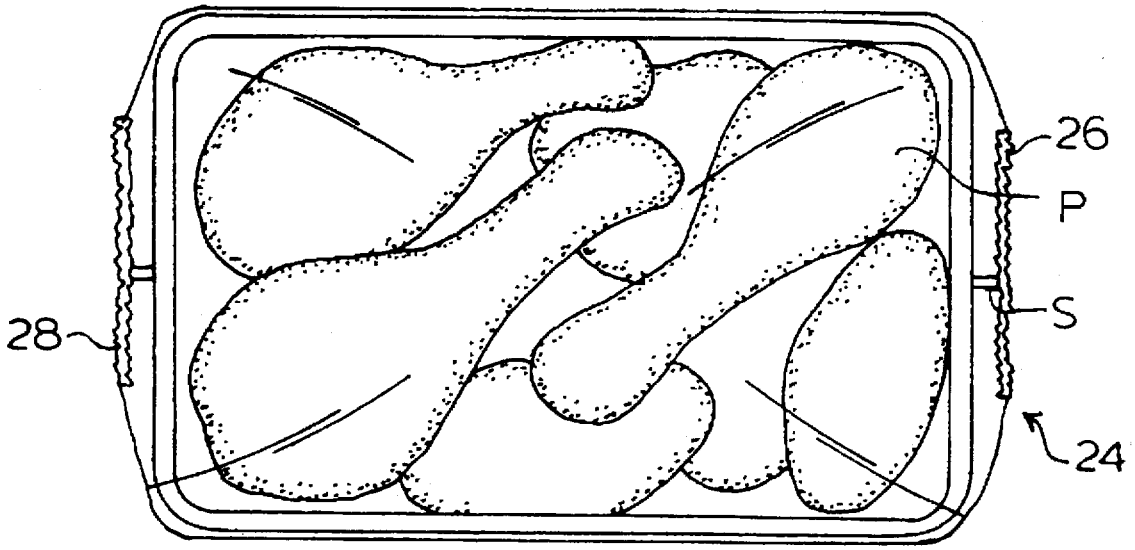
FIG. 5 PRIOR ART
FIG. 5 is a top plan view of a film wrapped product with transverse end seams as produced by a typical sealing apparatus and method of the prior art.

An illustration of the type problem to which the present invention is directed appears in FIG. 5, wherein leading transverse seam 26 and trailing transverse seam 28 of package 24, produced by a prior art machine and method, are portrayed as being irregular and also as being narrower in the transverse direction than the width of package 24. In other examples, the transverse seams of the prior art packages may have portions which are not sealed or are poorly sealed, thus causing a leak in the film envelope whose primary purpose is to provide product protection.

It is well known that the application of heat, for example heat from sealing bars, to a heat sealable film will cause some degree of film shrinkage to occur. The invention recognizes that by providing a method which allows the heated film portion to shrink away from the formed seam in the longitudinal direction while restraining the film against shrinkage in the transverse direction, a superior quality seam can be formed.

In contrast to the seam illustrated in FIG. 5, a seam formed by the method of the present invention is relatively smooth and straight with greater integrity and product protection provided. Such a wrapped and sealed product is shown in FIG. 6 where package 30 is shown as having substantially smooth and straight leading seam 32 and trailing seam 34 both of which extend transversely for substantially the full width of package 30.

Figure 1:
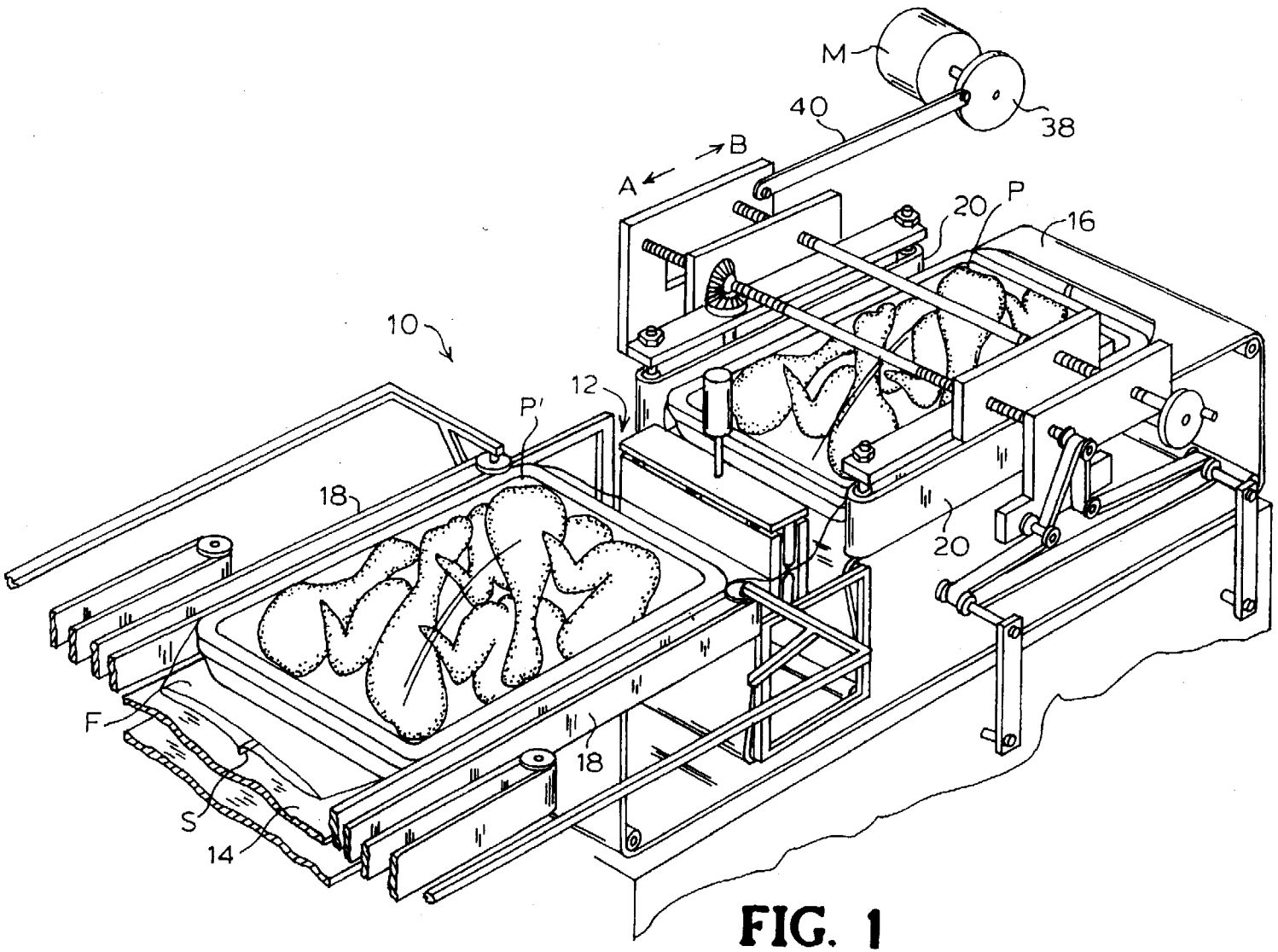
FIG. 1 is a perspective view of a portion of a machine including horizontal and vertical belts similar to that of U.S. Pat. No. 5,271,210 for wrapping a product in a heat shrinkable film and practicing the sealing method of the invention.
Figure 6:
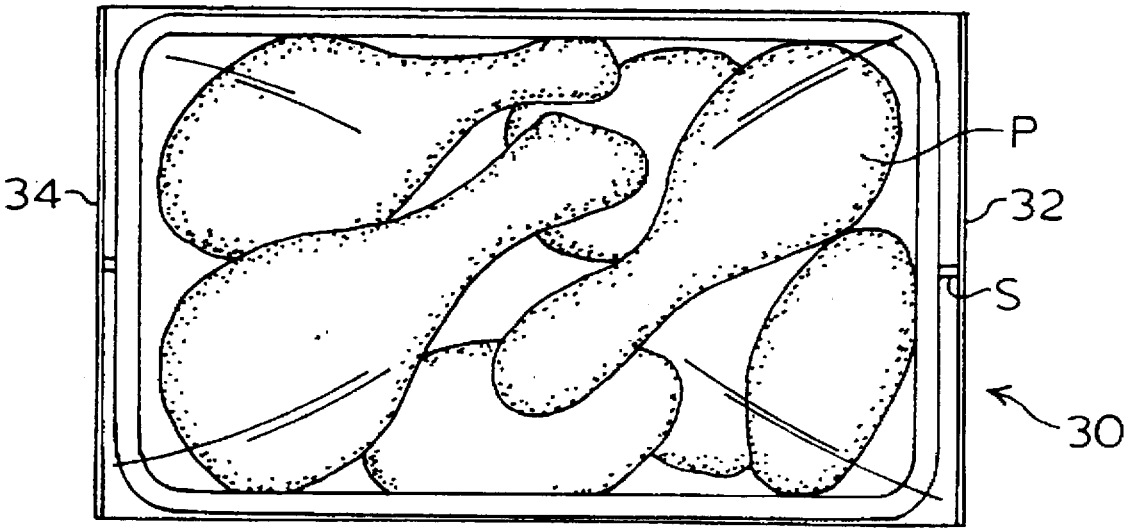
FIG. 6 is a top plan view of a film wrapped product with end seams formed according to the method of the present invention.

According to the objects outlined above and the seam quality improvement seen by comparison of FIG. 5 and FIG. 6, a portion of a machine 10 for wrapping a product in a heat shrinkable film is illustrated in FIG. 1. The features of the present invention are embodied in the operation of sealing mechanism 12, the balance of the machine being substantially known in the art. For purposes of discussion, the upstream direction is indicated by arrow A and the downstream direction by arrow B. Wrapping machine 10 has a horizontally oriented input conveyor 14 which sequentially transports a series of longitudinally separated products, represented as P, P', in a downstream direction as shown by arrow B. As products P, P' are transported downstream, film F in continuous sheet form is drawn from a film supply (not shown) and formed into a generally tubular configuration to enclose the series of products P, P' in sequence. A typical product to be wrapped is, for example, a tray packed with poultry parts. Heat and pressure are applied to seal the opposed longitudinal edges of sheet film F together beneath packages P, P' to form longitudinal seam S. Longitudinal seam S (FIG. 1) runs generally parallel to the longitudinal axis of the film tube and generally along the bottom of each sequential product P, P'.

Figure 2:
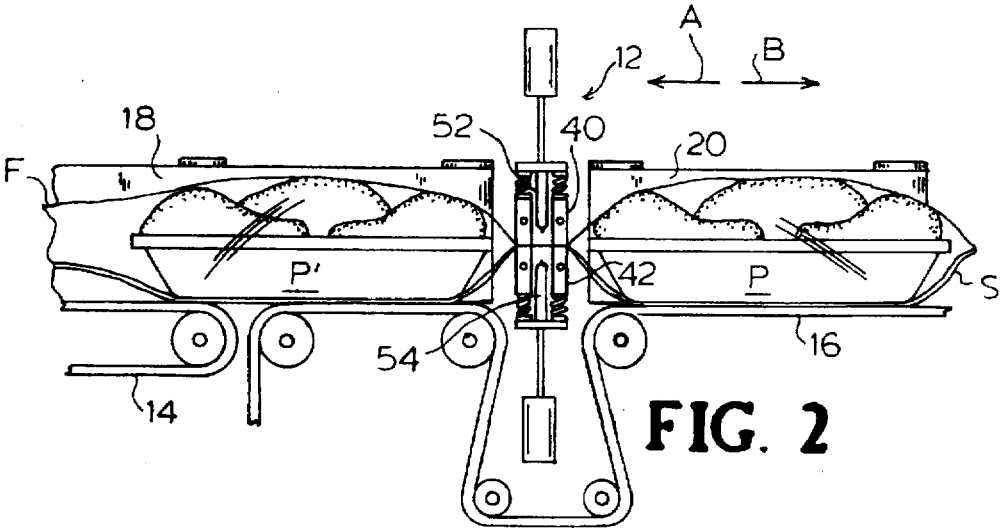
FIG. 2 is a partial side elevation view of the wrapping machine of FIG. 1 with the wrapping film held under tension between sets of upper and lower film clamps.

A transverse seam is formed by sealing film F across the film tube at a position between each two successive products P, P' by sealing mechanism 12 (see FIG. 2). Clamps 40, 42 of sealing mechanism 12 are pressed together against upper and lower portions of film tube F while the entire sealing mechanism 12 is moved downstream (in the direction of arrow B) in synchronization with the movement of film F. While clamps 40, 42 are firmly holding film F, sealing bars 52, 54 are brought into instantaneous contact with film F. At the completion of the sealing cycle, clamps 40, 42 quickly separate and the entire sealing mechanism 12 is returned upstream in the direction shown by arrow A as a next sequential package P' passes between film clamps 40 and 42 for another transverse sealing operation.

Vertically oriented upstream control belts 18, together with horizontally oriented input conveyor 14 move products P, P', wrapped in film F, sequentially toward the sealing mechanism 12. Control belts 18 firmly grip the side-surfaces of sequential products P, P' as product contacting surfaces of control belts 18 are extended and retracted in length. By this belt extending motion, the downstream end of each control belt 18 remains in relatively close proximity to oscillating sealing mechanism 12 to maintain control of the position and travel of each product P, P' until a transverse seam has been completed between each successive pair of adjacent products. Similar cyclic motion occurs with reciprocating, vertically oriented, downstream control belts 20 which are moved cyclically in synchronization with upstream side belt 18 by driver M (see FIG. 1) through eccentric 38 and connecting link 40. Driver M may be a motor or a speed reducer which is driven from a main motor (not shown) of wrapping machine 10. As described in the '210 patent, reciprocating downstream control belts 20 are driven in such manner as to revolve when moving in an upstream direction and to not revolve when moving in a downstream direction. In the example illustrated, input conveyor 14, gapped horizontal conveyor 16, and the pairs of vertical control belts 18 and 20 are driven at the same linear speed.

The present invention also recognizes that any material is considerably weaker when heated almost to its melting temperature than when it is cool. In the operation of wrapping and sealing film around a series of sequentially presented products, shown in side elevation in FIG. 2, film F is generally under longitudinal tension in the space between successive products P, P'. In this tensioned condition, when heated, film F tends to shrink longitudinally and pull apart between adjacent packages. Such longitudinal tension tends to cause film F also to be drawn between successive packages so as to be narrower in the transverse dimension than the width of product P. When a bi-axially oriented film F, which is a preferred wrapping material as discussed above, is heated, shrinkage in both the longitudinal and the transverse direction will occur.

Figure 3:
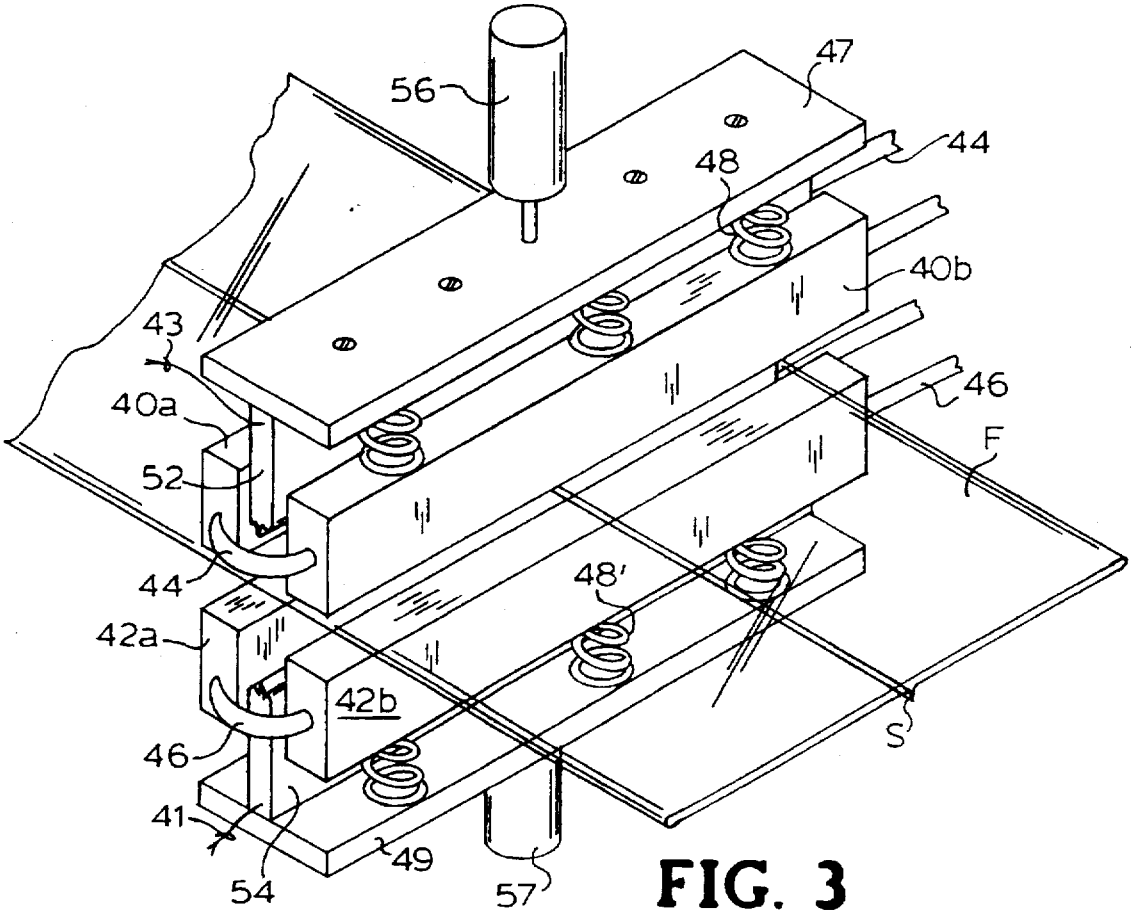
FIG. 3 is an enlarged perspective view of a pair of clamping and sealing mechanisms according to the invention method with opposing film clamps and sealing bar in upper and lower units.
Figure 7:
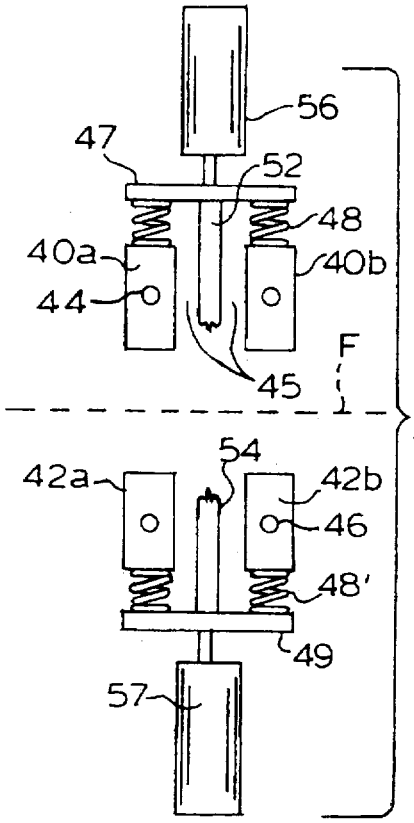
FIG. 7 is a side elevation of the heat sealing apparatus of FIG. 3.

A first embodiment of a sealing apparatus for performing the method of the invention is illustrated in perspective view in FIG. 3 and in end elevation view in FIG. 7, with upper and lower sealing mechanisms essentially being the mirror image of each other in structure and function. The upper sealing mechanism includes upper clamping member 40, (individual clamp members 40*a* and 40*b*) which are mounted on carrier bar 47 by resilient connectors 48, for example compression springs. A driver 56, such as a pressure-actuated cylinder, a servomotor, or the like, is connected so as to move carrier bar 47 vertically. A coolant tube 44 is connected from a coolant source (not shown) to circulate a coolant through each of the upper clamping members 40*a*, 40*b*. A heated sealing bar 52 is mounted rigidly to carrier bar 47 by screws or other means, and is positioned between cooled clamp members 40*a*, 40*b* with a minimal space 45 (see FIG. 7) maintained therebetween with either air or a barrier material (not shown) to serve as a thermal insulator. Upper sealing bar 52 and lower sealing bar 54 are positioned to engage opposite surfaces of film F and apply pressure against each other at a seal position as film F is being securely held between clamps 40, 42. According to FIGS. 1 and 2, sealing bars 52, 54 form a seal transversely across film F between each pair of packages P, P'. Sealing bars 52, 54 are of the electrical heated resistance type, being energized through wires 41, 43, respectively, in the preferred embodiment, although other heat means may be substituted. Clamping members 40, 42 and sealing bars 52, 54 are configured to extend transversely across the width of film F. A controller, such as a microprocessor (not shown) is connected so as to sequence and time the operations of upper driver 56 and lower driver 57. The operation of the sealing apparatus of the invention is best shown and described below with respect to the operational schematic of FIG. 4.

Figure 3A:
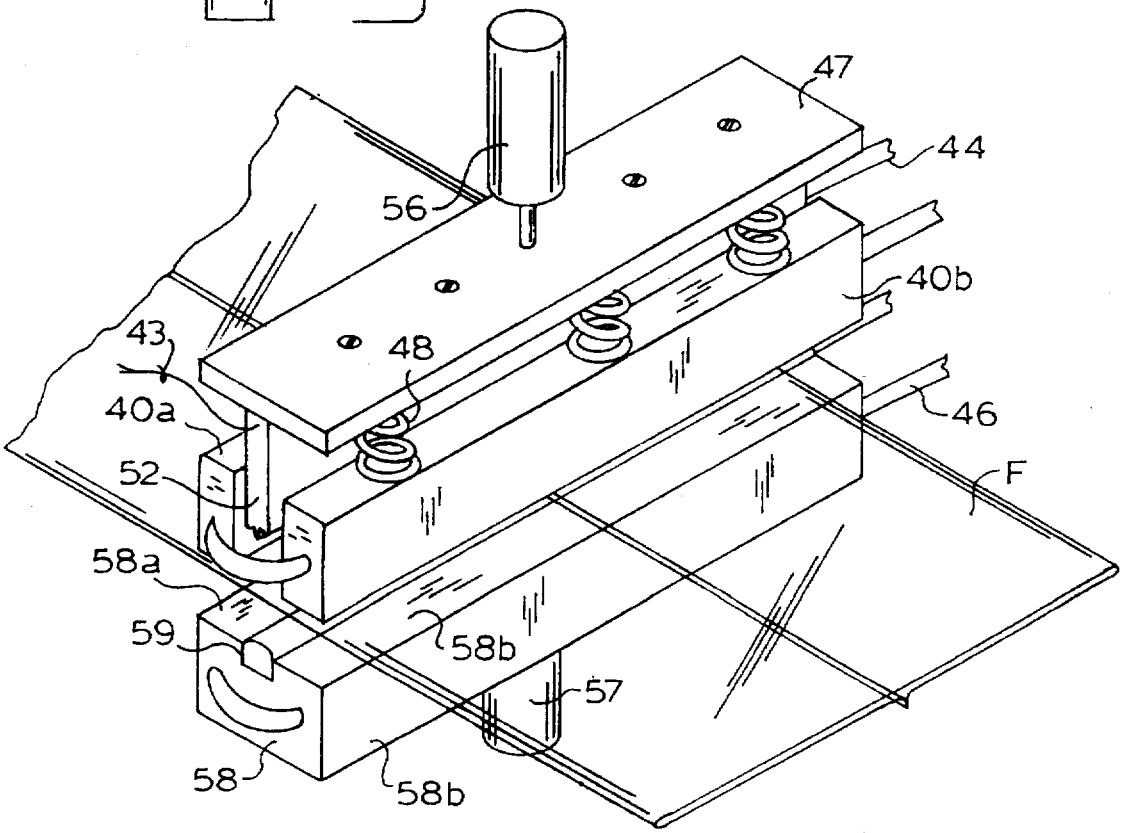
FIG. 3A is a similar view to that of FIG. 3 with the lower unit of the sealing mechanism comprising a central resilient pad mounted between film clamp surfaces.

A second embodiment of the apparatus for practicing the method of invention is shown in FIG. 3A. The apparatus illustrated as this second embodiment comprises an upper portion similarly configured and similarly numbered to the upper portion of the apparatus of FIG. 3, with the lower portion being mechanically more simple. In the lower portion of the sealing mechanism of FIG. 3A, platen 58 optionally mounts resilient sealing pad 59 in a position to support film F when upper sealing bar 52 is moved down by driver 56. Upper clamp members 40*a*, 40*b*, being cooled by coolant tube 44, engage side portions 58*a*, 58*b* of platen 58 respectively, which is cooled by coolant tube 46. Platen 58 and sealing pad 59 may remain fixed in position, or may be moved upwardly by driver 57 as sealing bar 52 is moved downwardly.

Figures 4A, 4B, 4C, 4D, 4E:
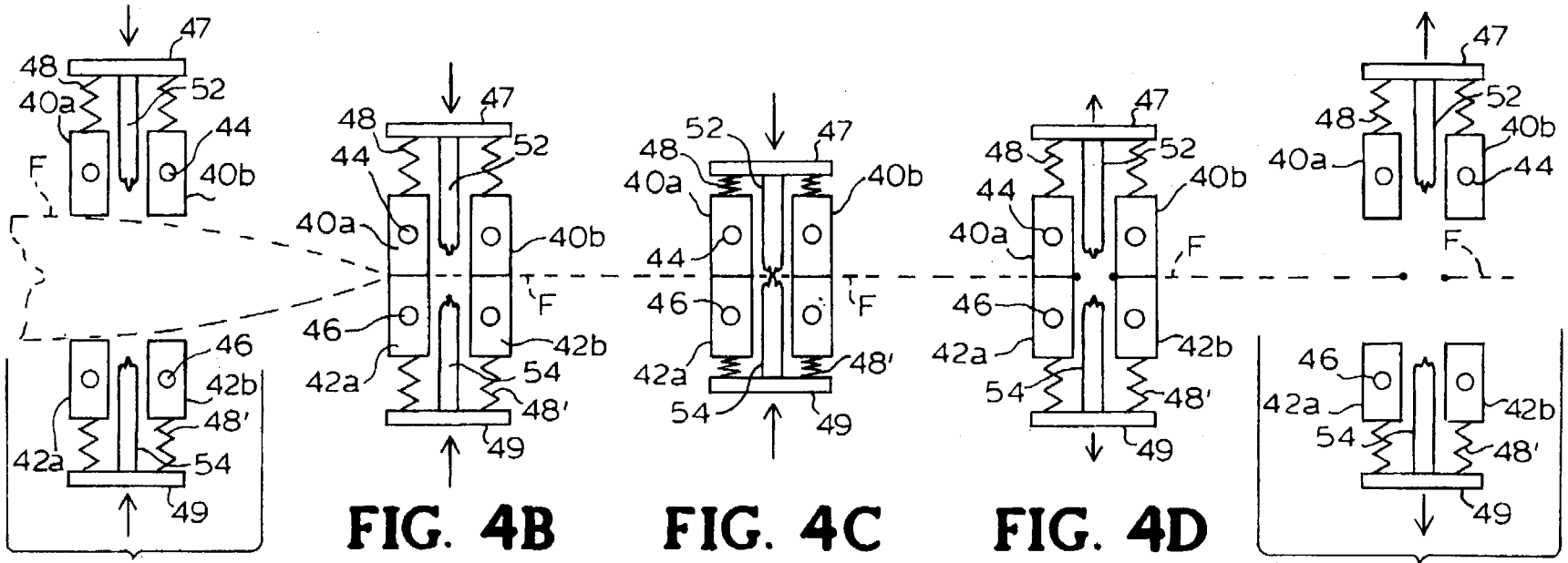
FIGS. 4A–4E display a schematic representation of the operative steps of the sealing apparatus according to the method of the invention.

The underlying principles Of the invention method are illustrated schematically in FIGS. 4A–4E. Product-filled packages are not included for clarity of illustration. The series of sequential operations in FIGS. 4A–4E are depicted by schematic end elevation views of the sealing mechanism of FIG. 3 performing the major steps of the method of the invention, progressing from left to right. Similar steps are performed with the apparatus of the second embodiment, shown in FIG. 3A. When operating apparatus such as that shown in FIG. 3A, the lower portions illustrated as clamps 42 and sealing bar 54 of FIG. 3 would be replaced by platen 58 and pad 59. Film F is shown in FIG. 4A as being two separate layers which are pressed together in FIGS. 4B–4E. The upper sealing mechanism comprises upper clamp members 40*a*, 40*b* with springs 48, upper cooling tube 44 and upper sealing bar 52, and the lower sealing mechanism comprises lower clamp members 42*a*, 42*b* with springs 48', lower cooling tube 46 and lower sealing bar 54. While the invention method described is intended for use with sealing bars being moved cyclically in an upstream and downstream direction in synchronization with the movement, for example, of packages P, P' according to the teaching of the '210 patent, use with other sealing apparatus such as rotating sealing apparatus, for example, is considered within the scope of the invention.

The first step of the sealing cycle is shown in FIG. 4B, as carrier bars 47, 49 are moved partially toward each other so that clamp members 40, 42 are brought together to press the two layers of film F into contact, while sealing bars 52, 54 remain remote from one another. Compression springs 48, 48' remain substantially fully extended. At this stage the film F is held for a short time so as to be immobile relative to heat sealing bars 52, 54, although it should be understood that the entire sealing mechanism and the film are moving in a downstream direction (from left to right as shown). In the illustration of FIG. 4C, upper and lower clamp members 40, 42 remain in firm contact with film F, carrier bars 47, 49 are moved closer to each other, and as upper sealing bar 52 and lower sealing bar 54 heated to a temperature sufficient to quickly seal film F are brought into momentary contact with film F for an infinitesimal time interval and pressure is applied to sealingly join the two layers of film F. The coolant circulating through each clamp member keeps the clamp members well below the film's melting temperature so that film F will not stick to, or be weakened by contact with, clamp members 40, 42.

In FIG. 4D, sealing bars 52, 54, having applied heat and pressure to film F for an instant, are moved apart by a partial separating movement of carrier bars 47, 49, while clamp members 40, 42, remain in contact with film F for a relatively long time as a coolant continues to circulate therethrough. The heat instilled in film F at the formed seam causes a parting of film F between successive packages and a longitudinal shrinkage so that each seam ultimately rests close to respective clamp members 40*a*, 42*a* and 40*b*, 42*b*. Cooled clamp members 40, 42 maintain pressure on film F until film F has cooled substantially below its melting temperature. Since clamping pressure is held on film F by clamp members 40, 42 which are of similar transverse dimension to the transverse width of film F, substantially no transverse shrinkage of film F occurs. The resultant seam is virtually wrinkle-free.

The clamp members 40, 42 are moved apart as illustrated in FIG. 4E after the formed seam has been cooled and stabilized. Since the machine sealing operation is cyclical, the positions of the components as shown in FIG. 4A and FIG. 4E actually represent the same point in each cycle. A sequential package (not shown) moves past the sealing mechanism while the upper and lower parts thereof are separated as in FIGS. 4A, 4E. The resultant seam is comparatively strong, smooth and substantially as wide as package P, as seen in FIG. 6.

The timing of each of the operational steps shown in FIGS. 4A–4E and the temperature of the sealing bars are variable to obtain optimum efficiency and product quality depending on the film used. According to the preferred embodiment, the application of heat to seal and part film F by sealing bars 52, 54 (or sealing bar 52 and pad 59) in step 4C is very short and the period of clamping is relatively long after the seal has been formed. The term "relative time" is used below to mean the percentage of time in a particular stage as compared to the total time required to complete a cycle. The total cycle may be less than one second when operating the packaging machine at a speed of 70 packages per minute. The last column of the chart below portrays the approximate relative time intervals in milliseconds when the total cycle is set at one second, for example, with a productivity rate of 60 packages per minute. A typical approximate relative time sequence for the clamping and sealing cycle is shown below according to the method of the invention:

| Figure | Operation | Relative Time | Time In Milliseconds |
|---|---|---|---|
| 4B | Clamps closed | 0.5% | 5 |
| 4C | Sealing bars in contact | 0.5% | 5 |
| 4D | Sealing bars open, clamps closed | 49% | 490 |
| 4E | Mechanism open, next package passes | 50% | 500 |

The transitional time for movement between one step to the next is intentionally omitted. Thus, the dwell time for shrinking, cooling and stabilizing the seam (FIG. 4D) while clamped is of the order of 100 times greater than the time of contact with the heated sealing bar (FIG. 4C).

While it is recognized that previously known heat sealing equipment has incorporated certain of the features of the present invention, the particular method disclosed is specifically designed to combine the objectives of allowing longitudinal shrink and restraining transverse shrink of the sealed film. By controlling the relative movement and timing of cool clamps and heated sealing bars with a microprocessor, a uniquely smooth, strong and uniform seam, extending substantially the transverse width of the package enclosed, is formed.

The invention method has been described and illustrated by means of operations utilizing either of a first or second preferred apparatus for purposes of example. It is recognized that numerous variations may be generated, which are considered to be within the scope of spirit of the present invention.

What is claimed is:

1. A method for sealing and parting longitudinally extending heat shrinkable film transversely between successive film wrapped products with a sealing mechanism, comprising the steps of:

(a) clamping said heat shrinkable film transversely at a position upstream and a position downstream of a transverse sealing position;

(b) substantially instantaneously after said clamping has been initiated contacting said heat shrinkable film at said sealing position with a transverse heated sealing bar at a first sufficient temperature and under sufficient pressure to cause said film within a first period of milliseconds to seal and part so that a first of said successive products separates from a second such product;

(c) rapidly removing said sealing bar from said sealing position immediately following the expiration of said first period of milliseconds;

(d) allowing for a second period of milliseconds substantially greater than said first period of milliseconds said clamped heat shrinkable film upstream and downstream of said sealing position to shrink in a longitudinal direction away from said sealing position while restraining transverse shrinkage thereof; and (e) after expiration of said second period of milliseconds unclamping said heat shrinkable film; and (f) repeating said sequence of steps after a third period of milliseconds substantially equal to said second period of milliseconds.

2. The method as described in claim 1 wherein said allowing said heat shrinkable film upstream and downstream of said sealing position to shrink in a longitudinal direction away from said sealing position while restraining transverse shrinkage comprises maintaining clamping pressure on said heat shrinkable film for said second period of milliseconds to allow said film in the area adjacent said sealing position to cool substantially below the melting temperature of said film.

3. The method as described in claim 1, further comprising the step during said second period of milliseconds of cooling the means used for clamping said film.

4. The method as described in claim 1, further comprising the step of moving said sealing mechanism in a downstream direction during the time of said clamping established by said second period of milliseconds and moving said sealing mechanism in an upstream direction during the time established by said third period of milliseconds said film is unclamped.

5. The method as described in claim 2, wherein the duration of said step of maintaining clamping pressure for said second period of milliseconds to allow said film in the area adjacent said sealing position to cool substantially below the melting temperature of said film is approximately 100 times greater than said step of instantaneously contacting said film with said heated sealing bar as established by said first period of milliseconds.

6. A method for sealing and parting heat shrinkable film transversely between successive products with a sealing mechanism, comprising the steps of:

(a) clamping said heat shrinkable film transversely at a position upstream and at a position downstream of a transverse sealing position;

(b) substantially instantaneously after said clamping has been initiated contacting said heat shrinkable film at said sealing position with a pair of upper and lower opposed transverse heated sealing bars at a sufficient temperature and under sufficient pressure to cause said film to seal and part in a very short time interval established by a first period of milliseconds so that a first of said successive products separates from a second such product;

(c) rapidly removing said sealing bars from said sealing position immediately following the expiration of said first period of milliseconds;

(d) allowing said heat shrinkable film upstream and downstream of said sealing position to shrink for a second period of milliseconds substantially greater than said first period of milliseconds in a longitudinal direction away from said sealing position while restraining transverse shrinkage thereof; and (e) after expiration of said second period of milliseconds unclamping said heat shrinkable film.

7. The method as described in claim 1 wherein said heat shrinkable film comprises a biaxially oriented polymeric film.

* * * * *